US005301747A

United States Patent [19]

Daschmann et al.

[11] Patent Number: 5,301,747

[45] Date of Patent: Apr. 12, 1994

[54] HEAT EXCHANGER COMPRISED OF INDIVIDUAL PLATES

[75] Inventors: Horst Daschmann; Gregor Schäfer; Horst Wittig, all of Ratingen, Fed. Rep. of Germany

[73] Assignee: Balcke-Durr Aktiengesellschaft, Ratingen, Fed. Rep. of Germany

[21] Appl. No.: 992,705

[22] Filed: Dec. 18, 1992

[30] Foreign Application Priority Data

Dec. 20, 1991 [DE] Fed. Rep. of Germany ..... 4142177

[51] Int. Cl.[5] ..... F28F 3/04

[52] U.S. Cl. ..... 165/166; 165/167

[58] Field of Search ..... 165/165, 166, 167

[56] References Cited

U.S. PATENT DOCUMENTS

| | | | |
|---|---|---|---|
| 2,777,674 | 1/1957 | Wakeman | 165/167 |
| 3,463,222 | 8/1969 | Grames | 165/166 |
| 3,517,733 | 6/1970 | Tasker et al. | 165/166 |
| 3,893,509 | 7/1975 | Satchwell et al. | 165/166 |
| 4,503,908 | 3/1985 | Rosman et al. | 165/167 |
| 4,799,539 | 1/1989 | Atkin et al. | 165/166 |
| 4,911,235 | 3/1990 | Andersson et al. | 165/167 |
| 5,069,276 | 12/1991 | Seidel | 165/167 |

FOREIGN PATENT DOCUMENTS

| | | | |
|---|---|---|---|
| 57169 | 1/1940 | Denmark | 165/167 |
| 14863 | 9/1980 | European Pat. Off. | 165/166 |
| 0252275 | 6/1987 | European Pat. Off. . | |
| 3429491 | 8/1984 | Fed. Rep. of Germany . | |
| 4100940 | 1/1991 | Fed. Rep. of Germany . | |
| 8808508 | 11/1988 | PCT Int'l Appl. . | |
| 8911627 | 11/1989 | PCT Int'l Appl. . | |
| 9117406 | 11/1991 | PCT Int'l Appl. . | |
| 737717 | 6/1980 | U.S.S.R. | 165/166 |
| 699037 | 10/1953 | United Kingdom | 165/166 |
| 1395439 | 6/1973 | United Kingdom . | |
| 1468514 | 7/1973 | United Kingdom . | |
| 2054817 | 2/1981 | United Kingdom . | |

*Primary Examiner*—John Rivell
*Assistant Examiner*—L. R. Leo
*Attorney, Agent, or Firm*—Robert W. Becker & Associates

[57] ABSTRACT

A heat exchanger comprised of individual plates has flow channels operating in parallel flow or counterflow. The flow channels for a first medium are defined between individual plates forming a pair and for the second medium are defined between the pairs that are arranged to form the heat exchanger stack. In order to distribute the inflowing medium within a short axial inflow area over the entire channel width, the individual plates are provided with guiding projections extending at least from one side of the plate into the respective flow channel. In order to improve the heat exchange efficiency, the individual plates have a profiling in the form of a plurality of individual protrusions arranged over the entire channel width and channel length for creating a flow turbulence in the flow channels.

25 Claims, 4 Drawing Sheets

HEAT EXCHANGER COMPRISED OF INDIVIDUAL PLATES

BACKGROUND OF THE INVENTION

The present invention relates to a heat exchanger comprised of individual plates with flow channels that can be used in counterflow and parallel flow operation. The flow channels are formed between two plates combined to form a pair and between adjacent ones of the pairs stacked atop one another to form the heat exchanger. The individual plates and the pairs formed from two plates are connected to one another at longitudinal rim portions extending parallel to the main flow direction. The inlets and the outlets of each flow channel are diagonally arranged in the main flow direction. The inlets and outlets of flow channels for one medium are arranged directly atop one another, while the inlets and outlets of the flow channels for the first medium are staggered relative to the inlets and outlets of the flow channels for the second medium by half the height of the pairs.

Heat exchangers of the aforementioned kind comprised of individual plates and having flow channels to be operated in counterflow are known from German patent 41 00 940. They are of an extremely compact construction, provide a high heat exchange efficiency, and can be produced inexpensively even for aggressive media.

It is an object of the present invention to improve the efficiency of the known heat exchangers, while simultaneously reducing their dimensions.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
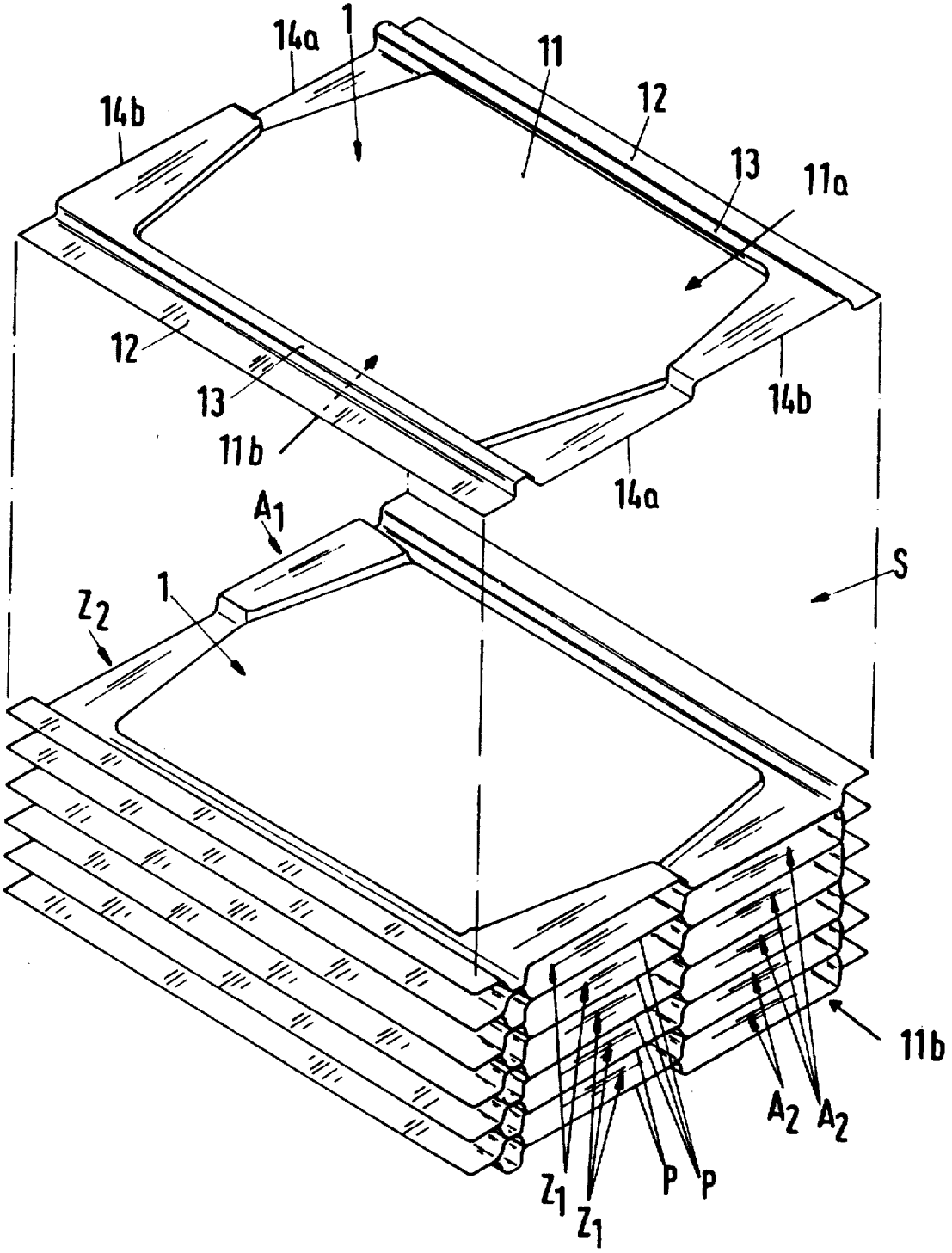
FIG. 1 is a perspective view of a heat exchanger comprised of a plurality of individual plates stacked atop one another whereby in order to simplify the drawing the inventive guiding projections and protrusions are not represented.

The heat exchanger for counterflow and parallel flow operation according to the present invention is characterized by:

Individual plates combined to pairs and the pairs stacked atop one another, with first flow channels for a first medium being formed between the plates of one pair and with second flow channels for a second medium being formed between adjacent ones of the pairs;

Each individual plate having longitudinal rim portions extending parallel to a main flow direction of the heat exchanger, the longitudinal rim portions of a first one of the individual plates connected to the longitudinal rim portions of a second one of the individual plates to form one pair, with the longitudinal rim portions of one pair connected to the longitudinal rim portions of an adjacent pair;

Each one of the first and second flow channels having an inlet and an outlet arranged diagonally opposite one another in the main flow direction;

The inlets and the outlets of the first flow channels arranged directly atop one another and the inlets and the outlets of the second flow channels arranged directly atop one another, with the inlets and the outlets of the first flow channels staggered relative to the inlets and the outlets of the second flow channels by half a height of one pair; and Each individual plate having a bottom side and a top side and comprising guiding projections on at least one of the bottom side and the top side at least within an inflow area of the first and second flow channels for distributing the respective first and second medium entering through the inlets over the full width of the first and second flow channels.

With the inventive guiding projections the medium entering the flow channels is evenly distributed over a very short axial flow section to the entire channel width of the flow channel so that dead spaces within the inflow area of the flow channels are almost completely prevented and essentially the entire area of the individual plates can be used for heat exchange between the two media. Due to the elimination of dead space a faster distribution of the medium entering the flow channel on one side over the entire channel width is achieved, and the efficiency of the heat exchange is increased. On the other hand, the almost complete use of the heat exchange surface area provided with the individual plates and their application in a true counterflow or parallel flow operation can be exploited, if needed, for a reduction of the outer dimensions of the heat exchanger without any loss of its heat exchange efficiency.

Preferably, the guiding projections are provided at the bottom side and the top side. Thus the guiding projections project from both sides into the flow channel. This allows for a reduction of the height of the individual guiding projections and thus results in a reduction of their soiling tendency.

Advantageously, within one inflow area of the first and second channels the guiding projections at the bottom sides are oppositely arranged to the guiding projections at the top side and have a gap therebetween. With this embodiment media that are laden with solid particles can be guided through the inventive heat exchanger without the danger of clotting the flow channels. The guiding projections are partially exposed to the medium flow so that the danger of a settling of solid particles at the guiding projections is substantially reduced.

In a further embodiment of the present invention, the guiding projections are angular and have a first leg that is essentially parallel to the main flow direction and a second leg positioned at an angle between 7° and 90° relative to the main flow direction. This embodiment ensures an especially effective and low-loss distribution over the entire channel width of the medium entering through the inlet. It may be especially advantageous when at least a number of the guiding projections has elongated second legs, especially when arranged in the longitudinal center portion of the individual plate. These elongated legs serve as additional guiding means and guide the inflowing medium into the portion of the flow channel which is remote from the inlet.

In another embodiment of the present invention, the end portions of the guiding projections which are facing the inlets are arranged at an angle relative to the main flow direction. This is a further very effective supporting measure for more evenly distributing the flow within the flow channels. Preferably, the guiding projections in the longitudinal center portion of the individual plates are positioned closer to the inlets than the guiding projections at the longitudinal rim portions.

In a further embodiment of the present invention the guiding projections within the inflow area are mirror-symmetrical to the projections within the outflow area.

An especially simple and inexpensive method of producing the guiding projections is realized by stamping the individual plates from one side.

In order to provide in addition to the inventive distribution of the inflowing media an increase of the heat exchange efficiency, the individual plates are provided with a profiling for generating flow turbulence, the profiling extending from the inflow area over the entire width and length of the individual plate defining the first and second flow channels. The generated turbulence increases the heat transfer and thus the effectiveness of the inventive heat exchanger.

In a preferred embodiment of the present invention the profiling is comprised of protrusions projecting alternately from the bottom side or the top side of the individual plate. Expediently, some of the protrusions are spacers for neighboring individual plates in order to ensure the desired distance between individual plates over the entire flow channel length and width even when the preset distance is very small. Spacers may also be provided at the guiding projections in order to ensure the preset distance of the individual plates also within the inflow and outflow areas.

DESCRIPTION OF PREFERRED EMBODIMENTS

The present invention will now be described in detail with the aid of several specific embodiments utilizing FIGS. 1 through 4.

FIG. 1 shows in a schematic perspective representation a first embodiment of a heat exchanger showing a stack S of a plurality of form-stamped individual plates 1 which are connected to one another to form pairs P.

Each individual plate 1 has a bottom 11 with a bottom side 11*b* and a top side 11*a*. The bottom 11 is positioned in a plane that is different from the plane of the longitudinal rim portions 12. Adjacent and parallel to these longitudinal rim portions 12 each individual plate 1 is provided with an abutment surface 13 which relative to the longitudinal rim portions 12 is at a different level. This displacement between the abutting surface 13 and the corresponding longitudinal rim portion 12 is twice as great as the displacement between the longitudinal rim portion 12 and the bottom 11. The bottom 11 is thus positioned at the middle between the plane of the longitudinal rim portion 12 and the plane of the abutting surface 13.

The rim portions extending transverse to the longitudinal rim portions 12 of the individual plate 1 in the shown embodiment are positioned approximately half within the plane of the longitudinal rim portion 12 and half within the plane of the abutting surface 13. In this manner, transverse rim portions 14*a* and 14*b* are produced which with respect to their height (level) relative to the plane of the bottom 11 are displaced by the same amount relative to one another as the planes in which, on the one hand, the longitudinal rim portions 12 and, on the other hand, the abutting surfaces 13 are located. FIG. 1 shows clearly that the transverse rim portions 14*a* and 14*b* at either end of the plate 1 are arranged diagonally opposite one another.

Two of the individual plates 1, represented as the top portion in FIG. 1, are connected to form a pair P according to the representation at the bottom of FIG. 1. FIG. 1 shows five complete pairs P, whereby atop the uppermost pair P an individual plate 1 is arranged which can also be connected to form a pair P to the uppermost individual plate 1 spaced at a distance in the representation of FIG. 1.

When the pairs P are connected within the area of the abutting surfaces 13 to form a stack S, flow channels result for the two media participating in the heat exchanging operation. The channels are arranged atop one another. While the first medium flows in flow channels which are formed between the pairs P, the second medium flows in the flow channels which result from combining the pairs P to the stack S. The transverse rim portions 14*a* of the individual plates 1 which are positioned in the plane of the longitudinal rim portions 12 form the inlet $Z_1$ and the outlet $A_1$ of the flow channels for the second medium flowing between the pairs P. The transverse rim portions 14*b* of the individual plates 1 located within the plane of the abutting surfaces 13 form the inlets $Z_2$ and outlets $A_2$ for the first medium which flows between the individual plates 1 of each pair P in the same direction as or counter to the direction of the second medium. FIG. 1 shows a counterflow heat exchanger and demonstrates that due to the diagonally opposite arrangement of the inlets and outlets the inlets $Z_1$, $Z_2$ for one medium are arranged adjacent to the outlets $A_2$, $A_1$ for the other medium and are staggered at half the height of one pair P.

Figure 2:
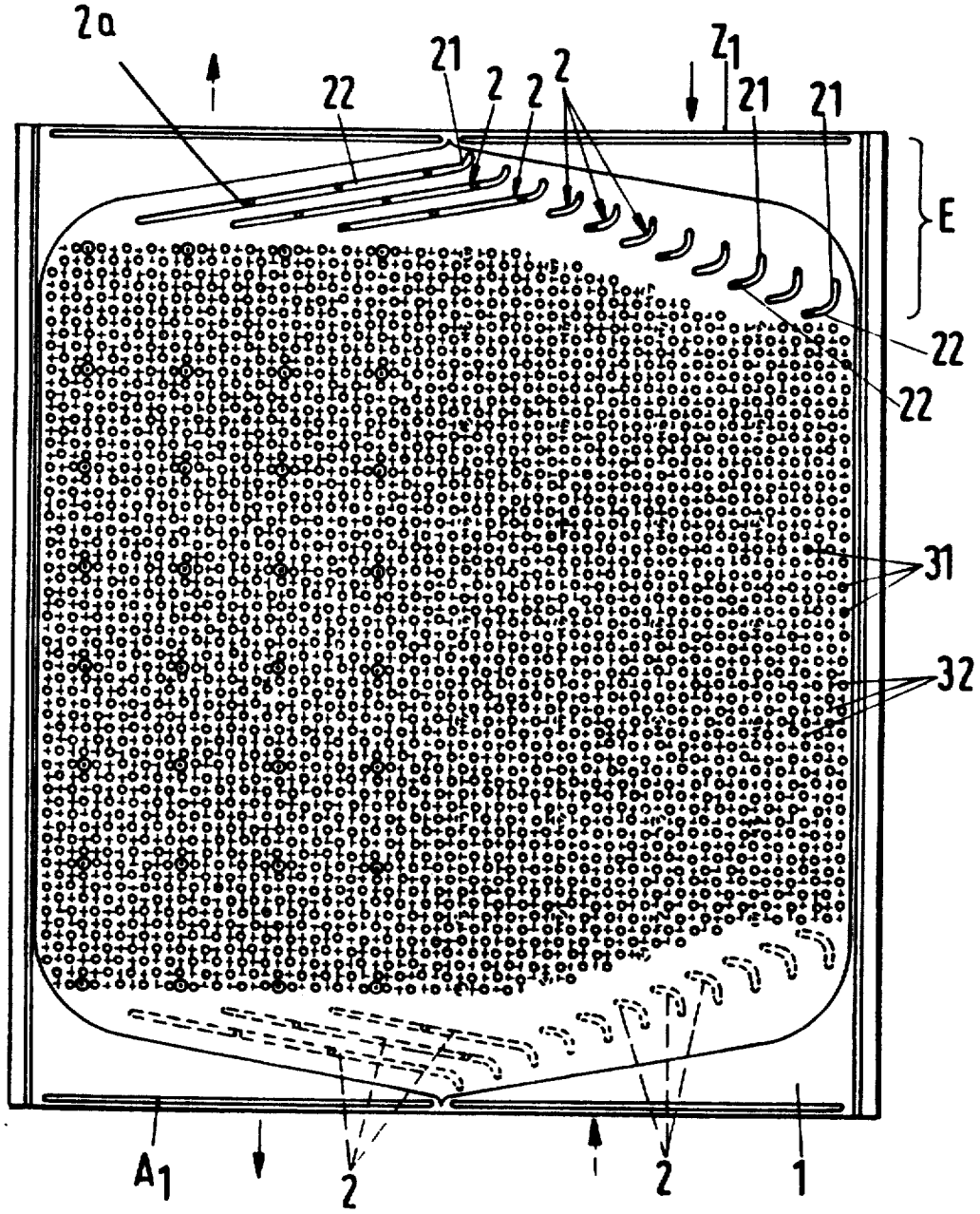
FIG. 2 is a plan view of a first embodiment of an individual plate with guiding projections and an array of individual protrusions.

In order to distribute the medium entering the flow channels via the inlets $Z_1$ and $Z_2$, which extend only over half the width of the flow channel, within a relatively short axial inflow area E over the entire width of the flow channel, the inflow area E is provided with guiding projections 2 as can be seen in the representation of one particular embodiment of the individual plate 1 in FIG. 2. The guiding projections 2 extend into the flow channel and distribute the medium entering via the inlets $Z_1$ and $Z_2$ over the entire channel width of the flow channel. In the embodiment represented in FIG. 2, the guiding projections are angular and have a first leg 21 that extends essentially parallel to the main flow direction and a second leg which extends at an angle between 7° and 90° relative to the main flow direction. This results in a row of guiding projections as can be seen in the upper part of FIG. 2. In order to be able to prevent dead space within the upper left portion of the flow channel of FIG. 2, the guiding projections 2 positioned at the center portion of the individual plate 1 may be provided with elongated second legs 22. Furthermore, it is advantageous when the end portions of the guiding projections 2 that are facing the inlets are arranged at an angle relative to the main flow direction whereby the guiding projections 2 in the longitudinal center portion of the individual plates 1 are arranged closer to the first and second inlets than the guiding projections at the longitudinal rim portions.

In the embodiment of a counterflow heat exchanger represented in FIG. 2, the guiding projections 2 are produced by one-sided stamping of the individual plate 1 whereby the projections 2 represented in a dash-dotted line at the lower portion of the FIG. 2 project into the other flow channel that is also delimited by the individual plate 1. In this manner, guiding projections 2 ar provided at both sides of the respective flow channel whereby between oppositely arranged projections 2 of two neighboring plates 1 a gap is provided which allows for a partial flow of the medium over the guiding projections 2 so that a clotting of the inflow area E with solid particles contained in the medium can be prevented.

In order to increase the heat exchanging efficiency of a heat exchanger provided with individual plates 1 according to the embodiment of FIG. 2, each individual plate 1 of the embodiment of FIG. 2 is further provided with a plurality of small protrusions extending from the inflow area E over the entire channel width and length. These individual protrusions 31, 32 project alternately to the bottom side 11*b* or top side 11*a* of the individual plate 1. The plan view of FIG. 2 shows the individual protrusions 31 at the top side 11*a* as a circle while the individual protrusions 32 projecting from the bottom side 11*b* are shown as a cross. The profiling in the form of an array of individual protrusions 31 and 32 in the two neighboring flow channels provides a turbulent flow over the entire length and width of the flow channel thereby increasing the heat exchanging efficiency of the heat exchanger.

With dots and crosses of a greater size it is indicated that some of the protrusions 31 and 32 are embodied as spacers for neighboring individual plates 1. The guiding projections 2 may also be provided with such spacers 2*a* which are indicated in FIG. 2 in the form of circles.

These spacers rest at spacers of neighboring individual plates so that in this manner the preset distance between neighboring individual plates 1 is ensured even under unfavorable conditions.

Figure 3:
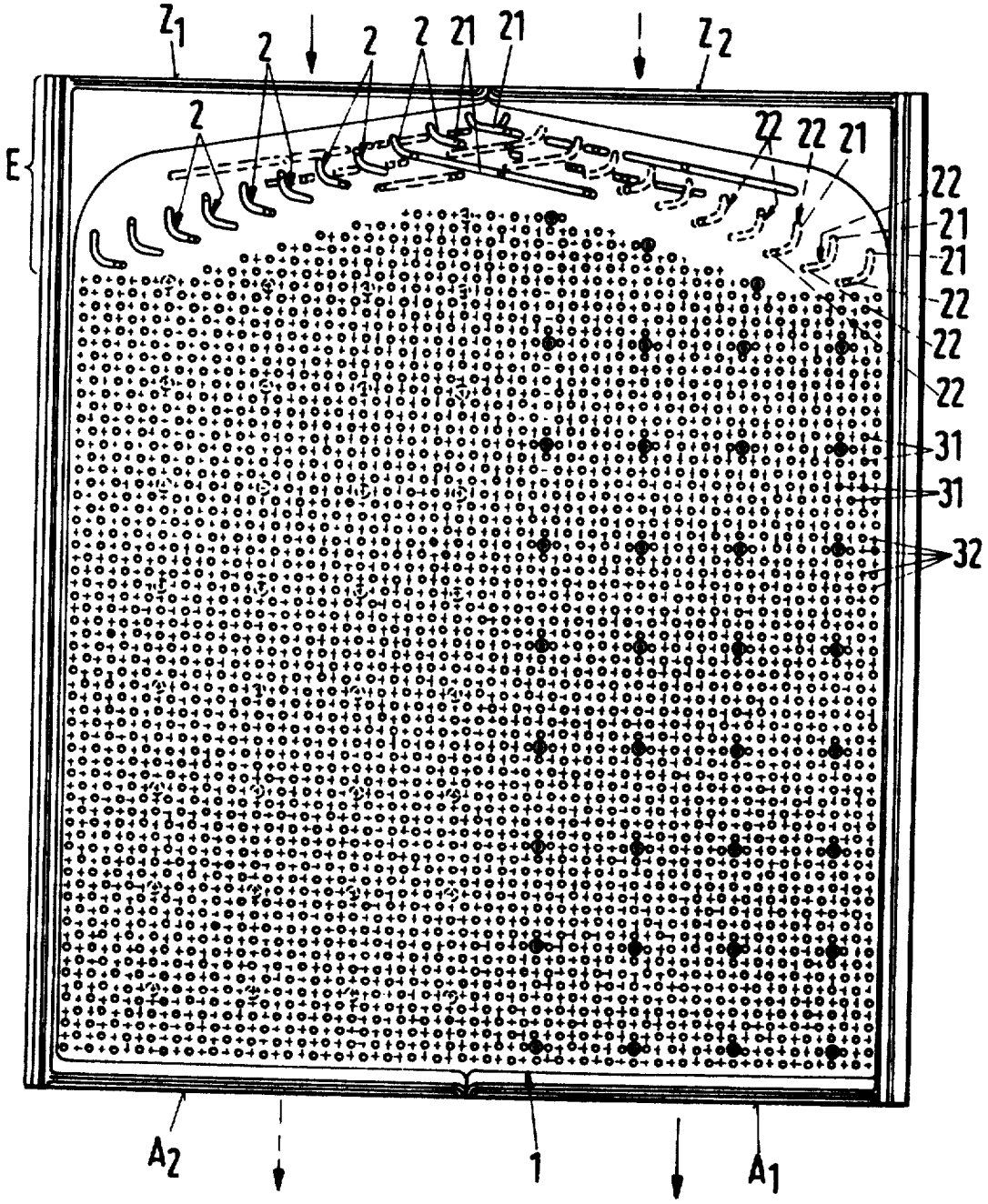
FIG. 3 is a plan view of a second embodiment of an individual plate for a heat exchanger to be used in parallel flow operation.

FIG. 3 shows an individual plate 1 for an inventive heat exchanger having flow channels for operation in parallel flow. Accordingly, the guiding projections 2 on the top side 11*a* have mirror-symmetrically arranged guiding projections 2 on the bottom side 11*b*. The flow of the first medium is indicated by an arrow in solid lines, while the other medium is indicated by a dash-dotted arrow.

Figure 4:
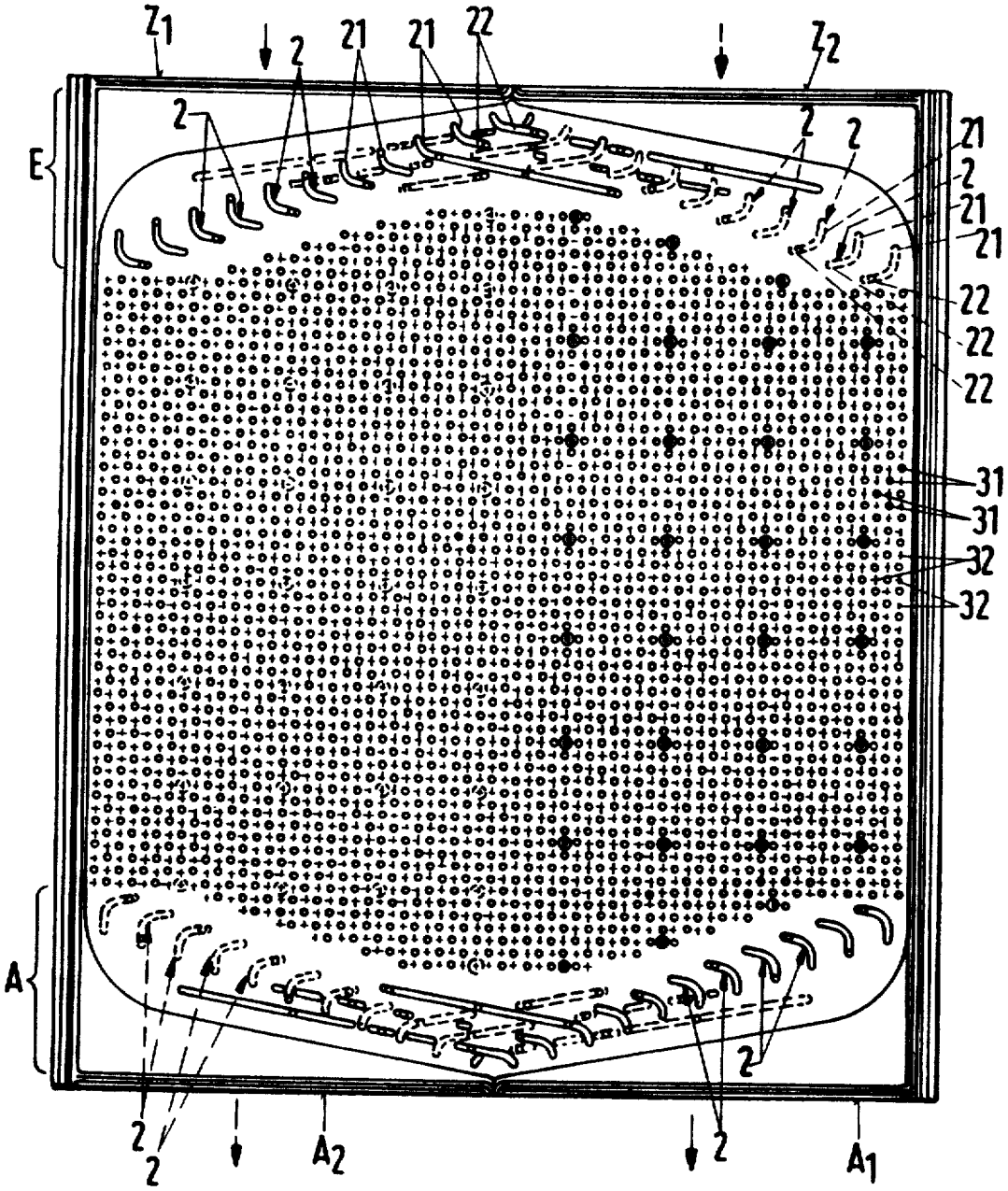
FIG. 4 is a plan view of a further embodiment of an inventive individual plate.

FIG. 4 shows an individual plate 1 which is also to be used for a parallel flow heat exchanger in which the guiding projections 2 are not only arranged within the inflow area E, but also within the outflow area F, whereby the guiding projections 2 at F are again mirror-symmetrically arranged relative to the first-mentioned guiding projections 2 within the inflow area E.

The present invention is, of course, in no way restricted to the specific disclosure of the specification and drawings, but also encompasses any modifications within the scope of the appended claims.

What we claim is:

1. A heat exchanger for counterflow and parallel flow operation, said heat exchanger comprised of:

individual plates combined to pairs and said pairs stacked atop one another, with first flow channels for a first medium begin formed between said plates of one said pair and with second flow channels for a second medium being formed between adjacent ones of said pairs;

each said individual plate having longitudinal rim portions extending parallel to a main flow direction of said heat exchanger, said longitudinal rim portions of a first one of said individual plates connected to said longitudinal rim portions of a second one of said individual plates to form one of said pairs, with said longitudinal rim portions of one said pair connected to said longitudinal rim portions of an adjacent said pair;

each one of said first and second flow channels having an inlet and an outlet arranged diagonally opposite one another in said main flow direction;

said inlets and said outlets of said first flow channels arranged directly atop one another and said inlets and said outlets of said second flow channels arranged directly atop one another, with said inlets and said outlets of said first flow channels staggered relative to said inlets and said outlets of said second flow channels by half a height of one said pair;

each said individual plate having a bottom side and a top side and comprising guiding projections on said bottom side and said top said eat least within an inflow area of said first and second flow channels for distributing the respective first and second medium entering through said inlets over the full width of said first and second flow channels; and wherein within one said inflow area of said first and second channel said guiding projections at said bottom side are oppositely arranged to said guiding projections at said top side and have a gap therebetween.

2. A heat exchanger according to claim 1, wherein said guiding projections are angular and have a first leg that is essentially parallel to said main flow direction and a second leg positioned at an angle between 7° and 90° relative to said main flow direction.

3. A heat exchanger according to claim 2, wherein at least a number of said guiding projections has elongated second legs.

4. A heat exchanger according to claim 3, wherein said guiding projections arranged in the longitudinal center portion of said individual plate have said elongated second legs.

5. A heat exchanger according to claim 1, wherein end portions of said guiding projections facing said inlets are arranged at an angle relative to said main flow direction.

6. A heat exchanger according to claim 1, wherein said guiding projections in the longitudinal center portion of said individual plates are positioned closer to said inlets than said guiding projections at said longitudinal rim portions.

7. A heat exchanger according to claim 1, wherein said guiding projections within said inflow area are mirror-symmetrical to said projections within an outflow area.

8. A heat exchanger according to claim 1, wherein guiding projections are made by a one-sided stamping of said individual plate.

9. A heat exchanger according to claim 1, wherein said individual plates have a profiling for generating flow turbulence extending from said inflow area over the entire width and length of said individual plate defining said first and second flow channels.

10. A heat exchanger according to claim 9, wherein said profiling is comprised of protrusions projecting alternately from said bottom side or said top side.

11. A heat exchanger according to claim 10, wherein some of said protrusions are spacers for neighboring ones of said individual plates.

12. A heat exchanger according to claim 1, wherein said guiding projections comprise spacers.

13. A heat exchanger for counter flow and parallel flow operation, said heat exchanger comprised of:

individual plates combined to pairs and said pairs stacked atop one another, with first flow channels for a first medium being formed between said plates of one said pair and with second flow channels for a second medium being formed between adjacent ones of said pairs;

each said individual plate having longitudinal rim portions extending parallel to a main flow direction of said heat exchanger, said longitudinal rim portions of a first one of said individual plates connected to said longitudinal rim portions of a second one of said individual plates to form one of said pairs, with said longitudinal rim portions of one said pair connected to said longitudinal rim portions of an adjacent said pair;

each one of said first and second flow channels having an inlet and an outlet arranged diagonally opposite one another in said main flow direction;

said inlets and said outlets of said first flow channels arranged directly atop one another and said inlets and said outlets of said second flow channels arranged directly atop one another, with said inlets and said outlets of said first flow channels staggered relative to said inlets and said outlets of said second flow channels by half a height of one said pair;

each said individual plate having a bottom side and a top side and comprising guiding projections on at least one of said bottom side and said top side at least within an inflow area of said first and second flow channels for distributing the respective first and second medium entering through said inlets over the full width of said first and second flow channels; and wherein said guiding projections are angular and have a first leg that is essentially parallel to said main flow direction and a second leg positioned at an angle between 7° and 90° relative to said main flow direction.

14. A heat exchanger according to claim 13, wherein aid guiding projections are provided at said bottom side and at said top side.

15. A heat exchanger according to claim 14, wherein within one said inflow area of said first and second channels said guiding projections at said bottom side are oppositely arranged to said guiding projections at said top side and have a gap therebetween.

16. A heat exchanger according to claim 15, wherein at least a number of said guiding projections has elongated second legs.

17. A heat exchanger according to claim 16, wherein said guiding projections arranged in the longitudinal center portion of said individual plate have said elongated second legs.

18. A heat exchanger according to claim 15, wherein end portions of said guiding projections facing said inlets are arranged at an angle relative to said main flow direction.

19. A heat exchanger according to claim 15, wherein said guiding projections in the longitudinal center portion of said individual plates are positioned closer to said inlets than said guiding projections at said longitudinal rim portions.

20. A heat exchanger according to claim 15, wherein said guiding projections within said inflow area are mirror-symmetrical to said projections within an outflow area.

21. A heat exchanger according to claim 15, wherein guiding projections are made by a one-sided stamping of said individual plate.

22. A heat exchanger according to claim 15, wherein said individual plates have a profiling for generating flow turbulence extending from said inflow area over the entire width and length of said individual plate defining said first and second flow channels.

23. A heat exchanger according to claim 22, wherein said profiling is comprised of protrusions projecting alternately from said bottom side of said top side.

24. A heat exchanger according to claim 23, wherein some of said protrusions are spacers for neighboring ones of said individual plates.

25. A heat exchanger according to claim 15, wherein said guiding projections comprise spacers.

* * * * *